United States Patent [19]

Maleki

[11] Patent Number: 5,015,864

[45] Date of Patent: May 14, 1991

[54] MOBILE RADIATION SHIELD

[76] Inventor: Massoud M. Maleki, 8620 N. Port Washington Rd., Milwaukee, Wis. 53217

[21] Appl. No.: 410,619

[22] Filed: Sep. 21, 1989

[51] Int. Cl.[5] ..... G21F 3/00

[52] U.S. Cl. ..... 250/516.1; 250/515.1; 250/519.1

[58] Field of Search ..... 250/516.1, 515.1, 517.1, 250/518.1, 519.1

[56] References Cited

U.S. PATENT DOCUMENTS

| | | | |
|---|---|---|---|
| 3,093,829 | 6/1963 | Maine | 250/516.1 |
| 3,164,840 | 1/1965 | Reynolds | 250/516.1 |
| 3,256,440 | 6/1966 | Stark . | |
| 3,308,297 | 3/1967 | Mansker . | |
| 4,254,341 | 3/1981 | Herr et al. | 250/519 |
| 4,386,277 | 5/1983 | Forshee | 250/516.1 |
| 4,417,146 | 11/1983 | Herbert | 250/516.1 |
| 4,460,833 | 7/1984 | Malamud | 250/519 |
| 4,581,538 | 4/1986 | Lenhart | 250/519 |

*Primary Examiner*—Edward P. Westin
*Assistant Examiner*—Kiet T. Nguyen
*Attorney, Agent, or Firm*—Andrus, Sceales, Starke & Sawall

[57] ABSTRACT

A mobile radiation shield apparatus to protect a physician or other personnel who may be exposed to stray radiation during diagnostic, therapeutic, or surgical procedures. The shield includes a frame composed of a pair of vertical frame members and a plurality of caster wheels are associated with each vertical frame member to provide mobility for the frame. A lead apron is removably attached to the frame, preferably by hook and loop fasteners, and a head piece is removably connected to the upper end of the frame to shield the head of the operator. The frame also includes a generally annular thrust bar that is adapted to encompass the waist of the user, so that the user by exerting a force against the thrust bar can maneuver the frame over the floor.

22 Claims, 2 Drawing Sheets

FIG. 3
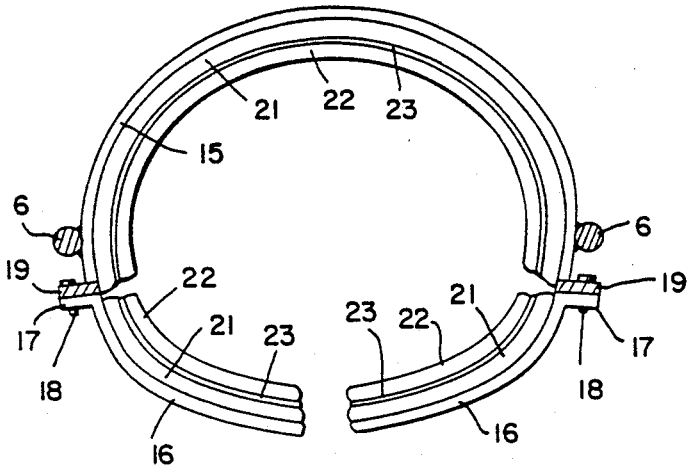
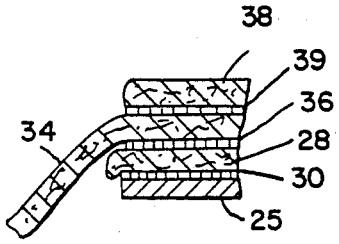
FIG. 6
FIG. 4
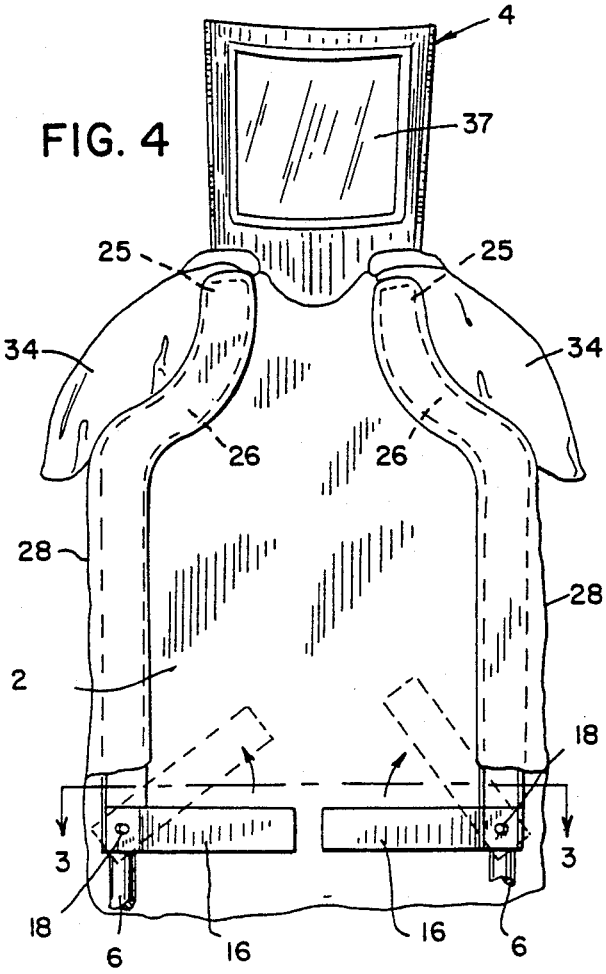
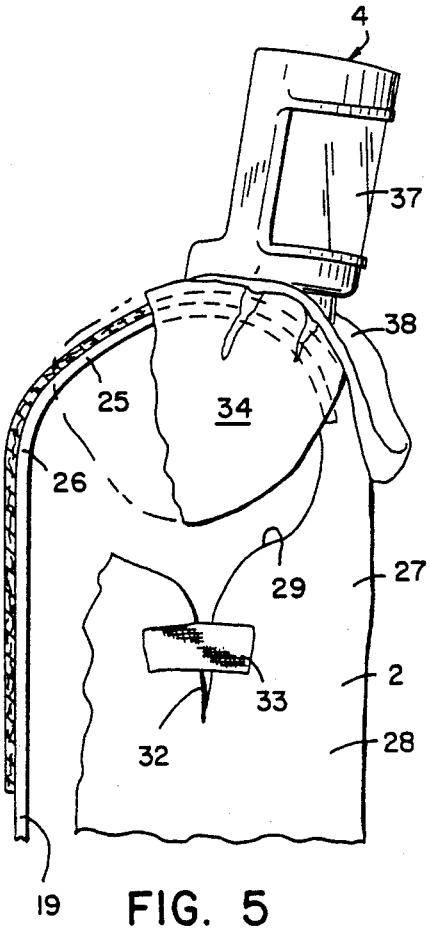
FIG. 5

MOBILE RADIATION SHIELD

BACKGROUND OF THE INVENTION

Physicians and other medical personnel are frequently exposed to stray radiation during diagnostic, therapeutic or surgical procedures. Exposure to stray radiation over prolonged periods can be dangerous. To shield against radiation it has been the practice for physician, or other personnel, to wear a protective lead apron, as well as a rigid lead glass head shield, which is attached to the upper portion of the apron. As the apron and head shield have a substantial weight, wearing of this equipment for prolonged periods is extremely fatiguing and can cause back pain and vertebral damage.

To overcome this problem, it has been proposed, as described in U.S. Pat. No. 4,254,341 to support the lead apron from an overhead dolley, so that the weight of the apron is not supported by the user. However, devices of this type provide limited maneuverability and in many instances, due to the installation of other overhead equipment, it is not possible to mount the supporting dolley in an overhead position.

U.S. Pat. No. 4,581,538 describes a radiation shield that includes a rigid radiation shielding window that is suspended from an overhead dolley and a series of flexible strips of radiation shielding material are suspended from the lower edge of the window. Again, devices of this type have limited maneuverability and as the user must part the flexible strips to perform a working operation, it does not give full protection for the body.

SUMMARY OF THE INVENTION

The invention is directed to an improved mobile radiation shield having particular use for protecting physicians, and other medical personnel, who may be exposed to stray radiation during diagnostic, therapeutic or surgical procedures.

The apparatus includes a mobile frame composed of a pair of vertical frame members, and a plurality of caster wheels are associated with the lower portion of each vertical frame member to enable the frame to be readily moved over the ground or terrain.

A lead apron is attached to the frame, preferably by Velcro fasteners, and a head piece including a lead glass window is provided with a flexible bib which is removably attached to the upper end of the frame, also by Velcro fasteners.

In addition, the frame includes a generally circular thrust bar, which is adapted to encompass the waist of the user, so that the user, by exerting a force against the thrust bar can move the frame over the ground.

The thrust bar is cushioned or padded and can be adjusted in diameter to accommodate different waist sizes. To provide a height adjustent, each vertical frame member is composed of a pair of telescopic sections, so that the vertical frame members can be adjusted to readily accommodate different heights.

As a further feature, the apparatus can also include a pair of lead shoulder flaps, which are connected together through a connecting strap, and each shoulder flap can be removably attached to the upper end of the frame and serves to protect the shoulders of the user.

With the apparatus of the invention, the entire weight of the apron and head piece is supported entirely by the frame. As the user is not required to support the heavy equipment over prolonged periods, fatigue is substantially reduced and vertebral pain and damage is eliminated.

The device is fully maneuverable through walking motion of the user. Thus, there is no limit to the maneuverability of the apparatus.

As the radiation shield is propelled by the user and does not require power operation, it is a relatively inexpensive device, as compared to prior art devices that required power operation.

The radiation shield provides full protection for the user, protecting not only the body and head, but also the shoulders.

The shield is fully adjustable. Vertical adjustment is provided for height and an adjustment is also provided for the waist size of the user.

The wheels or casters are arranged such that the leading or front edge of the apron extends slightly beyond the wheels, so that the user can move directly against a table or other object without interference from the wheels.

Other objects and advantages will appear in the course of the following description.

DESCRIPTION OF THE DRAWINGS

The drawings illustrate the best mode presently contemplated of carrying out the invention.

In the drawings:

FIG. 3 is a horizontal section showing the thrust bar in the closed condition;

FIG. 4 is a fragmentary enlarged rear elevation of the radiation shield;

FIG. 5 is a fragmentary side elevation of the shield with parts broken away; and FIG. 6 is an enlarged fragmentary section showing the attachment of the head piece and shoulder flaps to the frame.

DESCRIPTION OF THE ILLUSTRATED EMBODIMENT

Figure 1:
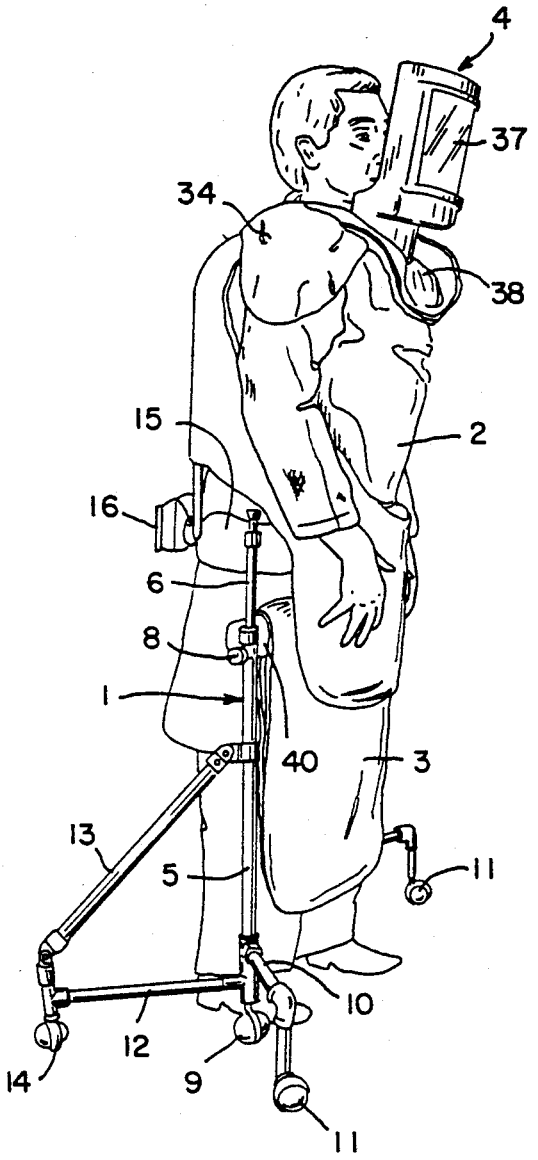
FIG. 1 is a perspective view of the radiation shield of the invention.

The drawings illustrate a radiation shield composed of a metal supporting frame 1 that supports an upper lead apron 2 and a lower lead apron 3, as well as a lead-glass head piece 4.

Frame 1 is composed of a pair of lower vertical tubular members 5 and a pair of upper rods 6, which are mounted for sliding or telescopic movement with respect to tubular members 5. Rods 6 can be locked with respect to tubular members 5 by set screws 7 that carry hand knobs 8. Through adjustment of rods 6 relative to lower tubular members 5, the frame 1 can be adjusted in height to accommodate the height of the user or operator.

Figure 2:
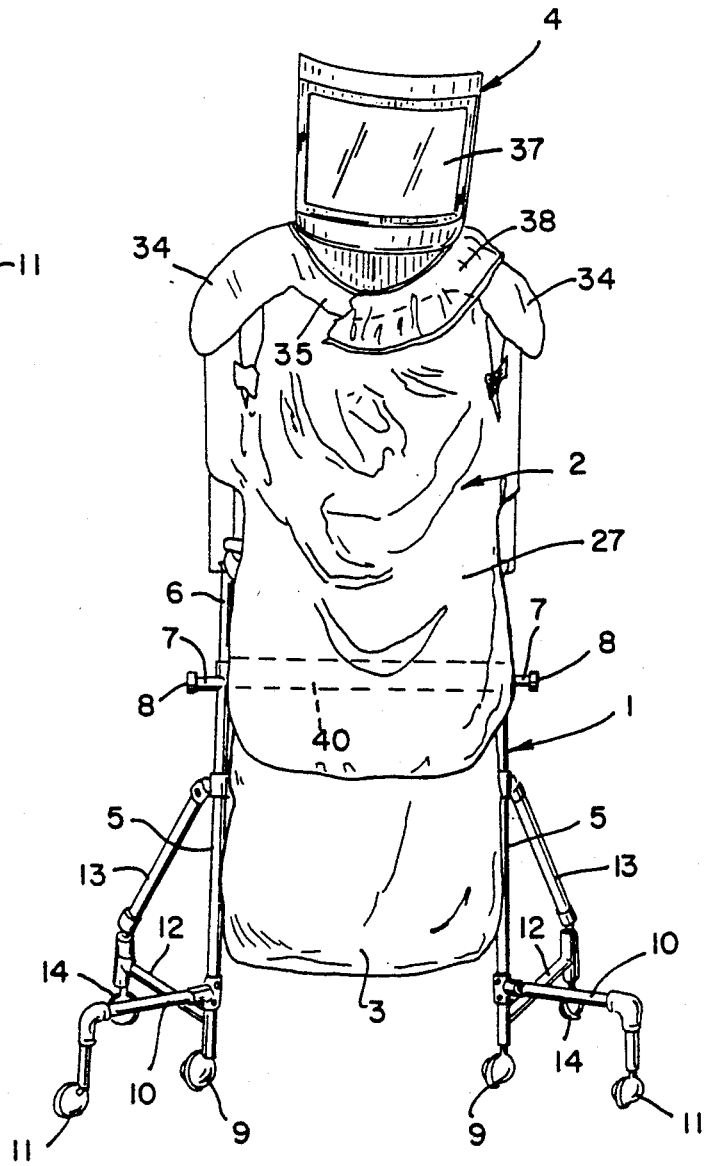
FIG. 2 is a perspective view of the front of the shield.

As shown in FIGS. 1 and 2, a caster wheel 9 is mounted on the lower end of each tubular member 5. In addition, a generally L-shaped brace extends laterally from the lower end of each member 5 and carries a second caster wheel 11. Extending rearwardly from the lower end of each tubular member 5 is a rear brace 12 and the outer end of brace 12 is connected to the respective member 5 by diagonal brace 13. A third caster wheel 14 is mounted at the outer junction of braces 12 and 13.

Caster wheels 9, 11 and 14 provide universal movement for frame 1 in all directions over the ground or terrain.

Connected to the upper ends of rods 6 is a curved metal thrust bar 15. As shown in FIG. 3, thrust bar 15 extends forwardly from rods 6 and apron 2 rests against bar 15.

A pair of generally curved thrust bar sections 16 are pivoted to the ends of bar 15. Each section 16 is provided with an outwardly extending flange 17 which is pivotally connected at pivot 18 to an upper frame member 19 that is secured to the respective ends of thrust bar 15, as seen in FIG. 3. Thrust bar sections 16 can be pivoted from a generally horizontal position, where they are coplanar with the forward thrust bar 15 to an upper generally vertical position, as shown by the dashed lines in FIG. 4. Suitable stops, not shown, are provided on to limit the downward pivotal movement of each section 16 and retain the section in the horizontal position.

When sections 16 are in the horizontal position, sections 16 along with the forward thrust bar 15, provide a substantially circular enclosure, as shown in FIG. 3, which is adapted to encircle the waist of the user. When the sections 16 are pivoted upwardly to the vertical position, the user can enter or exit the enclosure.

Bars 15 and 16 are cushioned or padded and in this regard a pad 21 formed of a soft or resilient material is secured to each of the bars 15 and 16, and a second pad 22 is secured to pad 21 via removable fasteners 23, such as a hook and loop (Velcro) fastening system. The use of the two pads 21 and 22 provides an adjustment to accommodate the waist size of the user. More specifically, if the user is relatively thin, both pads 21 and 22 can be employed, while if the user is relatively heavy the outer pad 22 can be removed.

Each upper frame member 19 is provided with a curved upper end portion 25 which is adapted to accommodate the shoulders of the user. As best shown in FIG. 4, each frame member 24 is provided with an inwardly bent or offset portion 26 located beneath the curved upper end 25 and the offset portion 26 facilitates entry of the shoulders of the user into the frame.

Apron 2 is of conventional construction and is composed of inner and outer layers of plastic or fabric material which enclose an inner liner of a radiation prevention material, such as lead. Apron 2 is provided with a front surface 27, and a pair of side surfaces 28 having arm holes 29, as seen in FIG. 5. The upper portions of the sides 28 are attached to the curved upper ends 25 of frame members 24 by removable hook and loop fasteners 30. In addition the rear vertical edges of sides 28 can be attached to frame members 19 through removable fasteners, such as hook and loop fasteners.

As illustrated in FIG. 5, the upper edge of each side 28 is provided with a gusset-like slit 32 and a strap 33 is connected to the edges bordering the slit by a removable fastener system, such as hook and loop fasteners. By adjusting the width of slit 32, the size of the armhole 29 can be varied.

It is also contemplated that a pair of shoulder flaps 34 can be attached to the frame to protect the shoulders of the user. As best seen in FIG. 2, shoulder flaps 34 are connected by a strip 35 and the upper edge of each shoulder flap 34 is connected to the portion of apron 2 which is mounted on the curved upper end 25 of frame members 19 by removable fasteners such as hook and loop fasteners 36. Shoulder flaps 34 and strip 35 are constructed similar to apron 2 and are composed of an inner liner of lead, or radiation prevention material, bordered by inner and outer layers of fabric or plastic material.

Head piece 4 includes a rigid lead-glass window 37 and a lead flexible bib 38 is connected to the lower end of window 37 and extends laterally. The outer ends of bib portion 38 are connected to the upper surfaces of shoulder flaps 34 by removable fasteners preferably a Velcro fastening system 39, as seen in FIG. 6. With this construction, the head shield is removably attached to frame 1 and can be located at various angles reltive to the frame to accommodate the particular task being performed by the user. In general, the window 37 in head piece 4 will be located at a slight downward angle to the vertical.

Frame 1 also includes a lower curved bar 40, which is attached to the tubular members 5 and extends forwardly of the tubular members. Apron 3, which is composed of material similar to apron 2, is suspended from bar 40 by removable fasteners, preferably a hook and loop system. If the user of the radiation shield is of substantial height the lower lead apron 3 can be utilized. However, if the user is of relatively short height, the lower lead apron 3 may not be employed.

With the radiation shield of the invention, the entire weight of the aprons 2 and 3 and head piece 4 is carried by the frame 1 rather than the user. This substantially reduces fatique to the user and eliminates the possibility of vertebral damage or pain.

The radiation shield is fully maneuverable by the user or operator. The operator merely walks over the floor, and in doing so, applies a force to the thrust bars 15 and 16, causing the shield to follow the movements of the user.

As the wheels or caster do not extend forwardly of the apron 2, the shield can be moved directly up against a table or other object without interference from the casters. To prevent forward tilting of the shield the rear braces 12 and diagonal braces 13, which are tubular metal members, can be filled with a weight, such as metal shot, and this added weight will aid in preventing forward tilting of the shield during use.

The radiation shield is adjustable for the height of the user, as well as the waist size and due to the removable hook and loop connections between the head piece 4 and the frame, the head piece can be readily adjusted in position relative to the frame and apron 2.

The radiation shield provides complete protection for the body, head and shoulders of the user.

Various modes of carrying out the invention are contemplated as being within the scope of the following claims particularly pointing out and distinctly claiming the subject matter which is regarded as the invention.

I claim:

1. A manually propelled radiation shield comprising a frame, caster wheel means for supporting the frame for universal movement on the ground, a flexible sheet of material capable of preventing the transmission of radiation carried by the frame, said frame including a generally annular thrust means constructed and arranged to be engaged by the body of a user to propel the frame over the ground in accordance with walking movement of the user.

2. The apparatus of claim 1, wherein said thrust means includes a movable member moved between an operative position wherein said user exerts a force against said movable member to propel said frame and a release position wherein said user enters and exits said annular thrust means.

3. The apparatus of claim 2, wherein said movable member is mounted for pivotal movement between a generally horizontal operative position and a generally vertical release position.

4. The apparatus of claim 3, wherein said movable member is mounted about a horizontal axis.

5. The apparatus of claim 1, wherein said annular thrust means includes a resilient pad disposed to be engaged by the waist of the user.

6. The apparatus of claim 5, wherein said annular thrust means includes a pair of overlapping resilient pads, and releasable fastening means for removably connecting the pads together.

7. The apparatus of claim 1, wherein said caster wheel means comprises a plurality of casters.

8. The apparatus of claim 1, wherein said caster wheel means comprises two groups of a plurality of casters, each group disposed at a side of said frame and arranged in a generally triangular pattern.

9. The apparatus of claim 8, wherein a first caster of each group is disposed in generally vertical alignment with the forward extremity of said frame.

10. The apparatus of claim 1, and including a head shield removably attached to the upper end of said frame and disposed to shield the head of the operator.

11. A mobile radiation shield, comprising a frame including a pair of generally vertical frame members, each frame member including an upper forwardly extending curved shoulder section, wheel means for supporting the frame for universal movement on the ground, a flexible apron including a radiation resistant material supported by said shoulder sections of said frame members, and annular thrust means interconnecting said vertical frame members and located beneath said shoulder sections, said thrust means being constructed and arranged to be engaged by the body of a user to thereby propel manually said frame over the ground in accordance with walking movement of said user.

12. The apparatus of claim 11, and including means for adjusting the height of each vertical frame member.

13. The apparatus of claim 12, wherein each vertical frame member includes a pair of telescopic sections, and locking means to lock the telescopic sections together.

14. The apparatus of claim 11, and including a generally curved frame section connecting the lower portions of said vertical frame members and disposed beneath said annular thrust means.

15. The apparatus of claim 14, and including a second apron containing a radiation resistant material and connected to said curved frame section.

16. The apparatus of claim 11, and including a head piece including a lead glass window, a bib attached to the lower end of said head piece and extending laterally of said window, and attaching means for removably attaching said bib to said shoulder sections of said frame members.

17. The apparatus of claim 11, and including a pair of shoulder flaps containing a radiation resistant material, flexible connecting means for connecting said flaps together, and attaching means for attaching said connecting means to the shoulder sections of said vertical frame members.

18. The apparatus of claim 16, wherein said attaching means comprises hook and loop fasteners.

19. The apparatus of claim 11, wherein said wheel means includes a plurality of casters associated with the lower end of each vertical frame member, a tubular brace connecting at least one of said casters to the respective vertical frame member and extending rearwardly of said vertical frame member, and weight means connected to said brace.

20. The apparatus of claim 19, wherein said brace is hollow and said weight means comprises a finely divided metal disposed within said hollow brace.

21. The apparatus of claim 19, wherein three casters are associated with each vertical frame member, a first of said three casters being vertically aligned with said vertical frame member, the second of said casters being disposed laterally outward of said vertical frame member and a third of said casters being disposed to the rear of said vertical frame member.

22. A mobile radiation shield, comprising a frame, wheel means for supporting the frame for universal movement on the ground, said frame including a thrust bar having an annular configuration and located between the upper and lower ends of said frame and disposed to be engaged by the body of a user to propel the frame over the ground in accordance with walking movement of the user, a flexible sheet of material capable of preventing the transmission of radiation carried by the frame and covering said annular thrust bar, said thrust bar having a rear section that is selectively removed from the annular configuration to provide a ga through which a user enters the frame, and means for securing said rear section in the annular configuration.

* * * * *

UNITED STATES PATENT AND TRADEMARK OFFICE

CERTIFICATE OF CORRECTION

PATENT NO. : 5,015,864

DATED : May 14, 1991

INVENTOR(S) : MASSOUD M. MALEKI

It is certified that error appears in the above-identified patent and that said Letters Patent is hereby corrected as shown below:

Col. 6, Line 46, CLAIM 22, Delete "ga" and substitute therefor --gap--

Signed and Sealed this

Twentieth Day of October, 1992

*Attest:*

DOUGLAS B. COMER

*Attesting Officer*

*Acting Commissioner of Patents and Trademarks*